US007008271B2

(12) United States Patent
Jørgensen

(10) Patent No.: US 7,008,271 B2
(45) Date of Patent: Mar. 7, 2006

(54) FEMALE CONNECTOR ASSEMBLY WITH A DISPLACEABLE CONDUCTOR

(75) Inventor: Martin Bondo Jørgensen, Værløse (DK)

(73) Assignee: Sonion Roskilde A/S, Roskilde (DK)

( * ) Notice: Subject to any disclaimer, the term of this patent is extended or adjusted under 35 U.S.C. 154(b) by 31 days.

(21) Appl. No.: 10/780,666

(22) Filed: Feb. 19, 2004

(65) Prior Publication Data

US 2004/0166740 A1 Aug. 26, 2004

Related U.S. Application Data

(60) Provisional application No. 60/448,098, filed on Feb. 20, 2003.

(51) Int. Cl.
*H01R 13/415* (2006.01)
*H01R 29/00* (2006.01)

(52) U.S. Cl. ..... 439/743; 439/48

(58) Field of Classification Search ..... 439/660, 439/682, 743, 48

See application file for complete search history.

(56) References Cited

U.S. PATENT DOCUMENTS 4,125,309 A 11/1978 Grantiz et al.
4,466,684 A 8/1984 Grant et al.
5,622,514 A * 4/1997 Crompton et al. ..... 439/342
6,443,739 B1 * 9/2002 Currie ..... 439/55
6,623,290 B1 * 9/2003 Tran ..... 439/342
6,651,322 B1 * 11/2003 Currie ..... 29/840

FOREIGN PATENT DOCUMENTS

FR 1 454 215 7/1966

* cited by examiner

*Primary Examiner*—Chandrika Prasad
(74) *Attorney, Agent, or Firm*—Harness, Dickey & Pierce, P.L.C.

(57) ABSTRACT

The present invention relates to a female connector assembly, comprising a base part having one or more conductor channels, each conductor channel having a first and a second end. Each of the one or more conductor channels houses at least one bent resilient conductor having a first portion and a second portion, where the second portion is displaceable in a track defined in at least a part of the base part. The first portion extends through the second end of the conductor channel. Each conductor channel is adapted to receive a rod-shaped conductor from a male connector assembly so that the rod-shaped conductor is retained in that conductor channel by a biasing force provided by the bent resilient conductor of that conductor channel.

35 Claims, 8 Drawing Sheets

FEMALE CONNECTOR ASSEMBLY WITH A DISPLACEABLE CONDUCTOR

Figure 1:
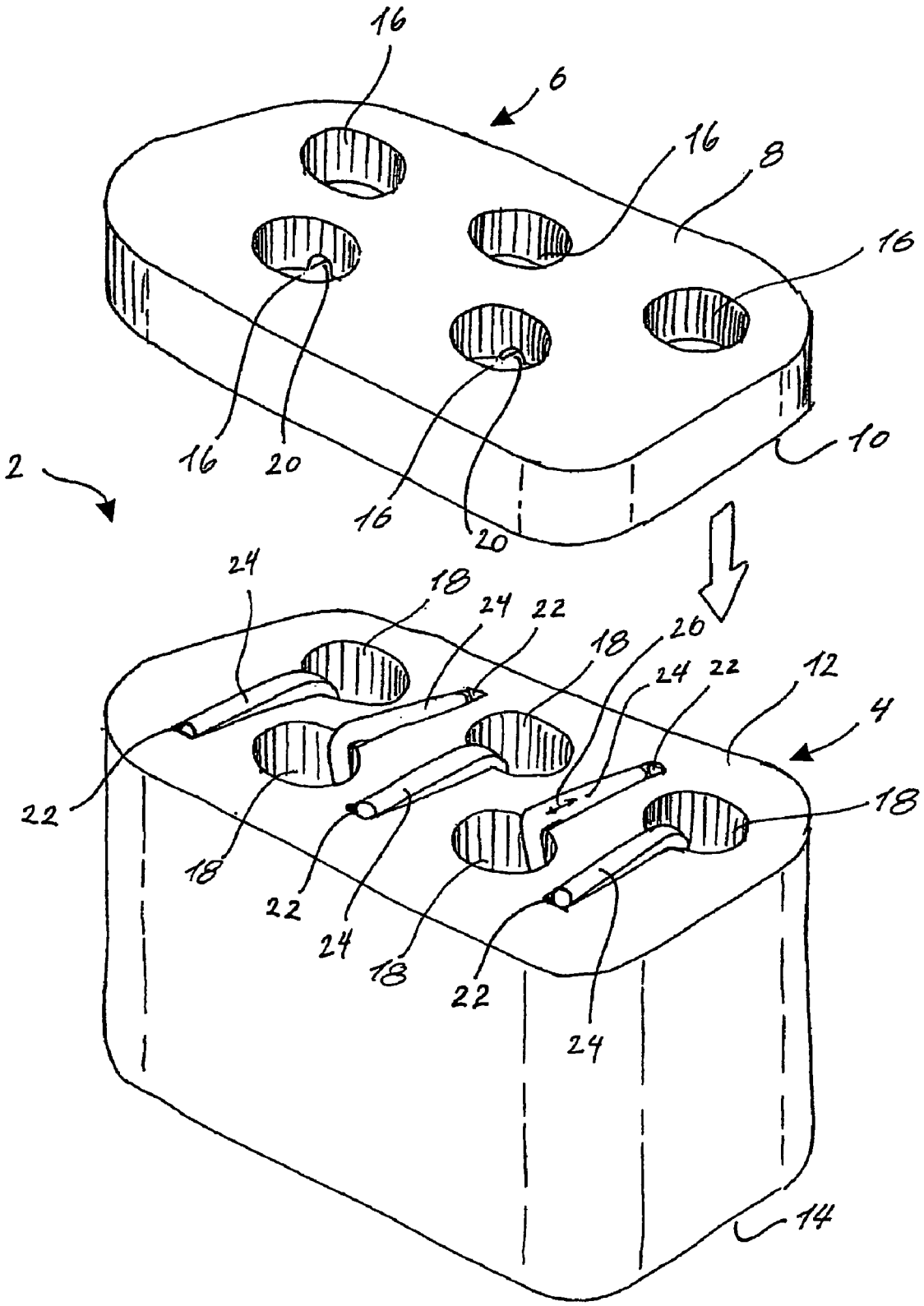

This application claims the benefit of Provisional application Ser. No. 60/448,098, filed Feb. 20, 2003.

FIELD OF THE INVENTION

The present invention relates to a connector for providing electrical connection between a first conductor and a second conductor. In particular, the present invention relates to miniature connector assemblies having small dimensions so as to be used in e.g. hearing aids.

BACKGROUND OF THE INVENTION

U.S. Pat. No. 4,125,309 discloses a miniature pin board assembly comprising a miniature matrix having coplanar conductive strips in a first row overlaid by a second row of coplanar strips. Both rows of strips are embedded within a moulded substrate of an elastomer-based material which is sufficiently rigid to maintain the rows in a predetermined spatial relationship.

A plurality of recesses is arranged in the substrate. The recesses are arranged in columns and rows. Each recess exposes a conductor in the first row and a conductor in the second row where such conductors cross each other.

A conductive pin may be inserted into a selected aperture to engage the corresponding exposed conductors, thereby making a cross point connection. The elastomer-based material encircling the selected recess is elastically expanded upon insertion of the pin and exerts a resilient and residual retention force on the pin biasing the same into positive electrical contact with the cross point connected conductors.

The resilient properties around the recesses of the pin board assembly of U.S. Pat. No. 4,125,309 are provided by the elastomer-based material. Thus, it is the mechanical properties of the elastomer-based material that keeps a male connector (pin) in position when inserted into a recess. Furthermore, the pin board assembly of U.S. Pat. No. 4,125,309 is mainly suitable for mounting on e.g. printed circuit boards.

U.S. Pat. No. 4,466,684 discloses a low insertion force connector with resilient metal conductors in the openings of an insulating connector body. Each conductor has a square opening and has integral leaf springs extending from the respective sides of the square towards a terminal entry end of the openings. The four leaf springs are grouped in two pairs that can engage with the entering terminal either simultaneously or shifted relative to each other. To orient and to fixate the conductors in the openings the conductors comprise tabs precisely fitted to be received in grooves of the connector body.

It may be an object of a preferred embodiment of the present invention to provide a miniaturised connector assembly where the resilient properties are provided by a resilient conductor in a simple way.

It may also be an object of a preferred embodiment of the present invention to provide a miniaturised connector assembly comprising a reduced number of mechanical elements.

SUMMARY OF THE INVENTION

The above-mentioned objects are complied with by providing, in a first aspect, a female connector assembly, comprising a base part comprising one or more conductor channels, each conductor channel having a longitudinal centre axis, a first end, and a second end, and a bent resilient conductor comprising first and second portions separated by a bend and having the first portion positioned in a conductor channel, wherein said conductor channel is adapted to receive a rod-shaped conductor from a male connector assembly so that the rod-shaped conductor is retained in said conductor channel by a biasing force provided by the bent resilient conductor positioned in said conductor channel, wherein the second portion of the bent resilient conductor is displaceable in a track disposed at a surface of the base part upon receiving the rod-shaped conductor in said conductor channel. Preferably, the first and second portions of the bent resilient conductor are substantially perpendicular. Preferably, the track is disposed at a surface of the base part being substantially perpendicular to the centre axis of said conductor channel.

Each of the one or more conductor channels may host at least one resilient conductor. At least a part of the track, in a cross-section, may define a semi-circle. It may also be so that at least a part of the track encircles at least a part of the second portion of the bent resilient conductor displaced in the track.

The female connector may further comprise a top part arranged on the base part. The base and the top part may, in combination, define the track so that one part of the track is defined in the base part whereas another part of the track is defined in the top part. The track may be defined by a first recess defined in a surface of the base part and a second recess defined in a surface of the top part.

Preferably, the top part is fixedly attached to the base part. This fixed attachment may be provided by several means such as a snap-lock, threads in either base or top part being adapted to receive bolts or the like. The top part may also be glued to the base part or the top part may be attached to the base part by providing heat to either of the two parts. Also, techniques such as ultrasonic welding may be applied to attach the top part to the base part.

A conductor recess may be defined in at least one of the conductor channels. The conductor recess may extend continuously from the first end of the conductor channel to the second end of the conductor channel. The first portion of the bent resilient conductor may be adapted to be received in the conductor recess when the second portion is received in the track.

A third portion of the bent resilient conductor may be defined between the first portion and the second portion, the third portion being adapted to engage with at least a part of the rod-shaped conductor from a male connector assembly. The third portion may comprise a sharply bended section, said bended section being adapted to engage with e.g. a recess of the rod-shaped conductor.

The female connector may further comprise blocking means for blocking at least a part of the track so as to limit the sliding movement of the second portion of the bent resilient conductor when displaced in the track. The blocking means may be a separate rod inserted in the track or it may be implemented by tapering the track to dimensions smaller than the second portion of the bent resilient conductor.

The female connector may further comprise sealing means adapted to seal at least one of the conductor channels. The sealing means may further be adapted to provide a fluid tight seal. The sealing means may comprise a flexible membrane having a passage adapted to receive the rod-shaped conductor of the male connector. The flexible membrane may be made of a rubber or a silicone material. Preferably, the flexible membrane may comprise a bead. Preferably, the sealing means is positioned between the base part and a top part. More preferably, the top part is fastened to the base part. In principle, the top may be fastened by any means such as gluing, soldering, interface locking, clamping, joining by heating, snap-locking, welding or the like. Preferably, ultrasonic welding is applied to fasten the top part to the base part. The sealing means may also be fastened to the base part and/or the top part by any suitable means such as ultrasonic welding, welding, laser welding, gluing, joining by adhesive strips and joining by heating, In principle, the base part may comprise an arbitrary number of conductor channels, such as 1, 2, 3, 4, 5 or even more conductor channels.

Preferably, the female connector has a volume between 2 $mm^3$ and 10 $mm^3$, such as between 4 $mm^3$ and 8 $mm^3$, 5 $mm^3$ and 7 $mm^3$, such as approximately 6 $mm^3$. The cross-sectional area of at least one of the conductor channels is preferably between 0.1 and 0.3 $mm^2$, such as approximately 0.2 $mm^2$.

The female connector may in principle take any form. Thus, the base and/or top part may define, in a plane substantially perpendicular to the conductor channels, a substantially rectangular cross-sectional shape. The length of the connector may for example be approximately 2.5–3.0 mm, more preferably 2.67 mm. The width of the connector may for example be approximately 1.3–1.7, more preferably 1.53 mm. The height of the connector may for example be approximately 1.2–1.8, more preferably 1.6 mm. Alternatively, the base and/or top part may define, in a plane substantially perpendicular to the conductor channels, a substantially circular cross-sectional shape. The diameter of the substantially circular shape may be within the range 1–2 mm.

At least one of the bent resilient conductors may be fabricated in a material selected from the group consisting of aluminium, magnesium, titanium, copper, nickel, zinc, tin, lead, chrome, tungsten, molybdenum, silver, gold, platinium and any alloy thereof. The base part and/or the top part may be fabricated in a material selected from the group consisting of elastomers, polymers and any other plastic material.

BRIEF DESCRIPTION OF THE INVENTION

Figure 2:
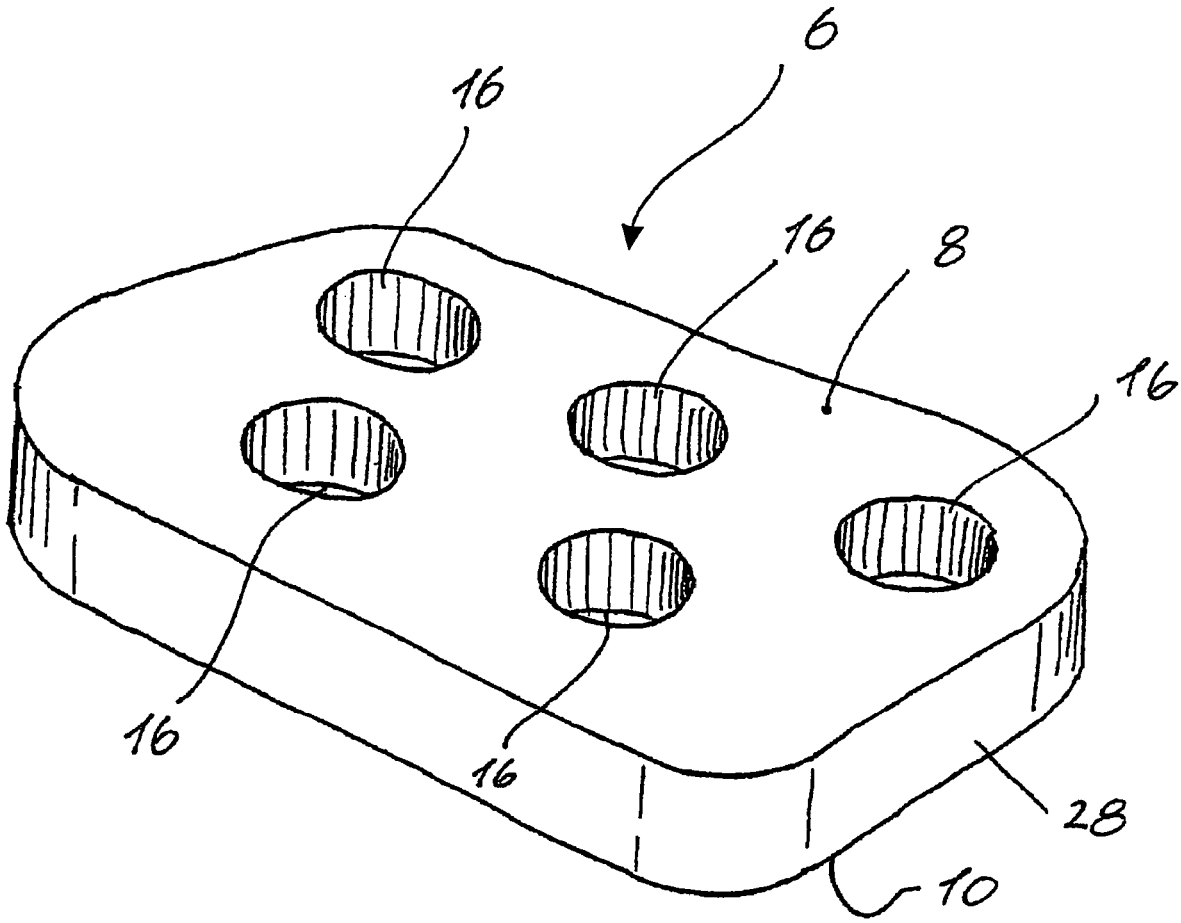
Figure 3:
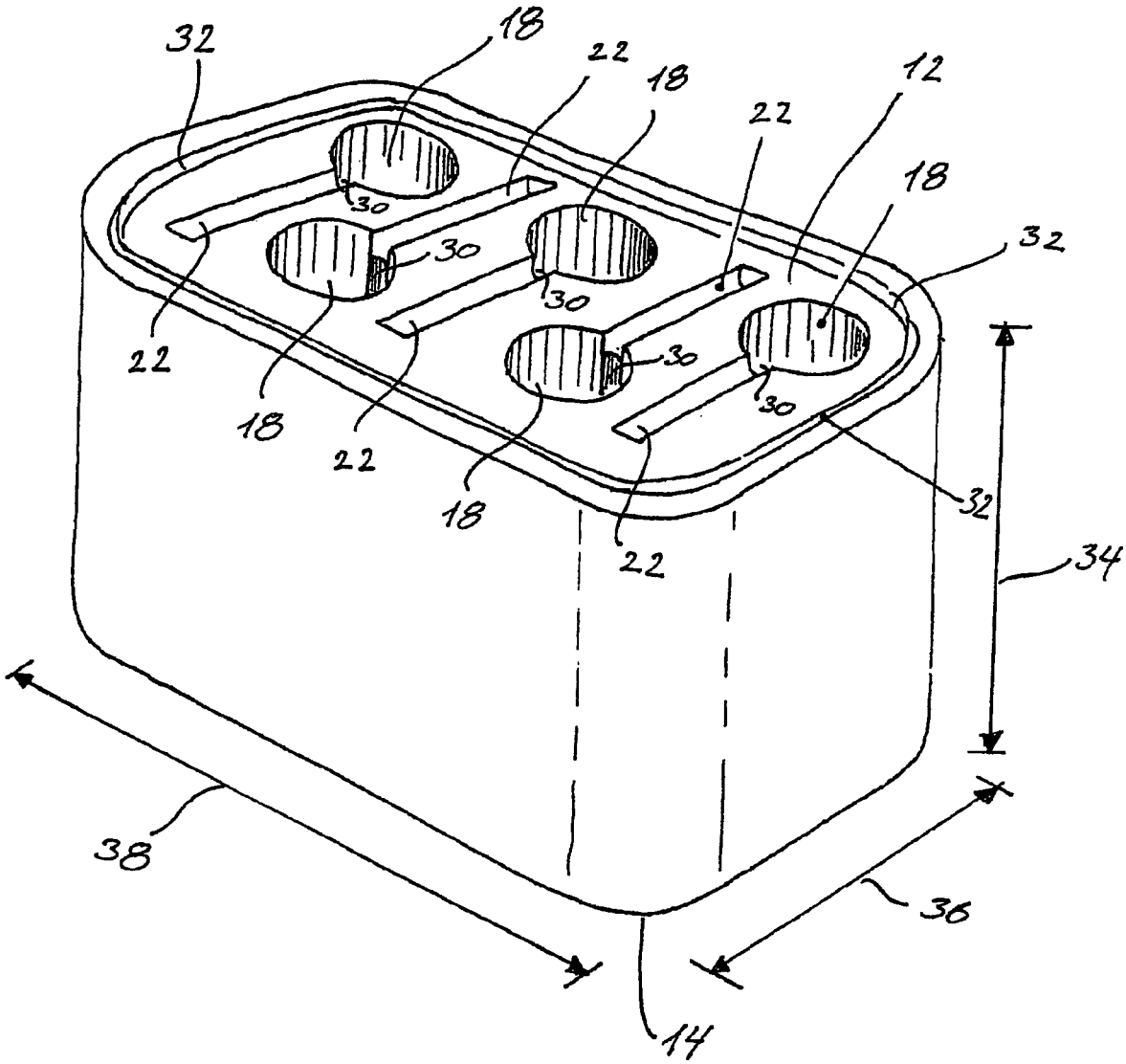
Figure 4:
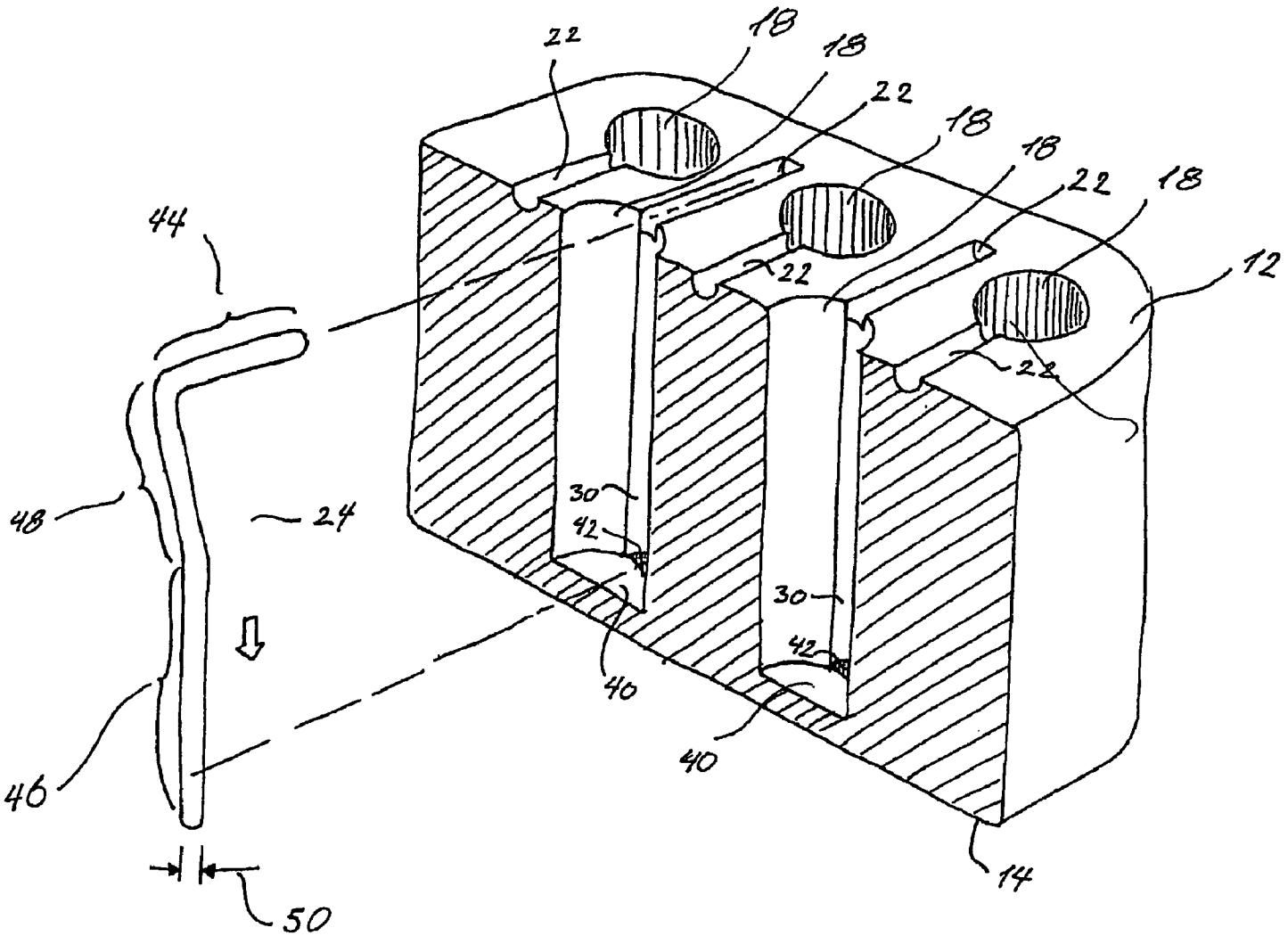
Figure 5:
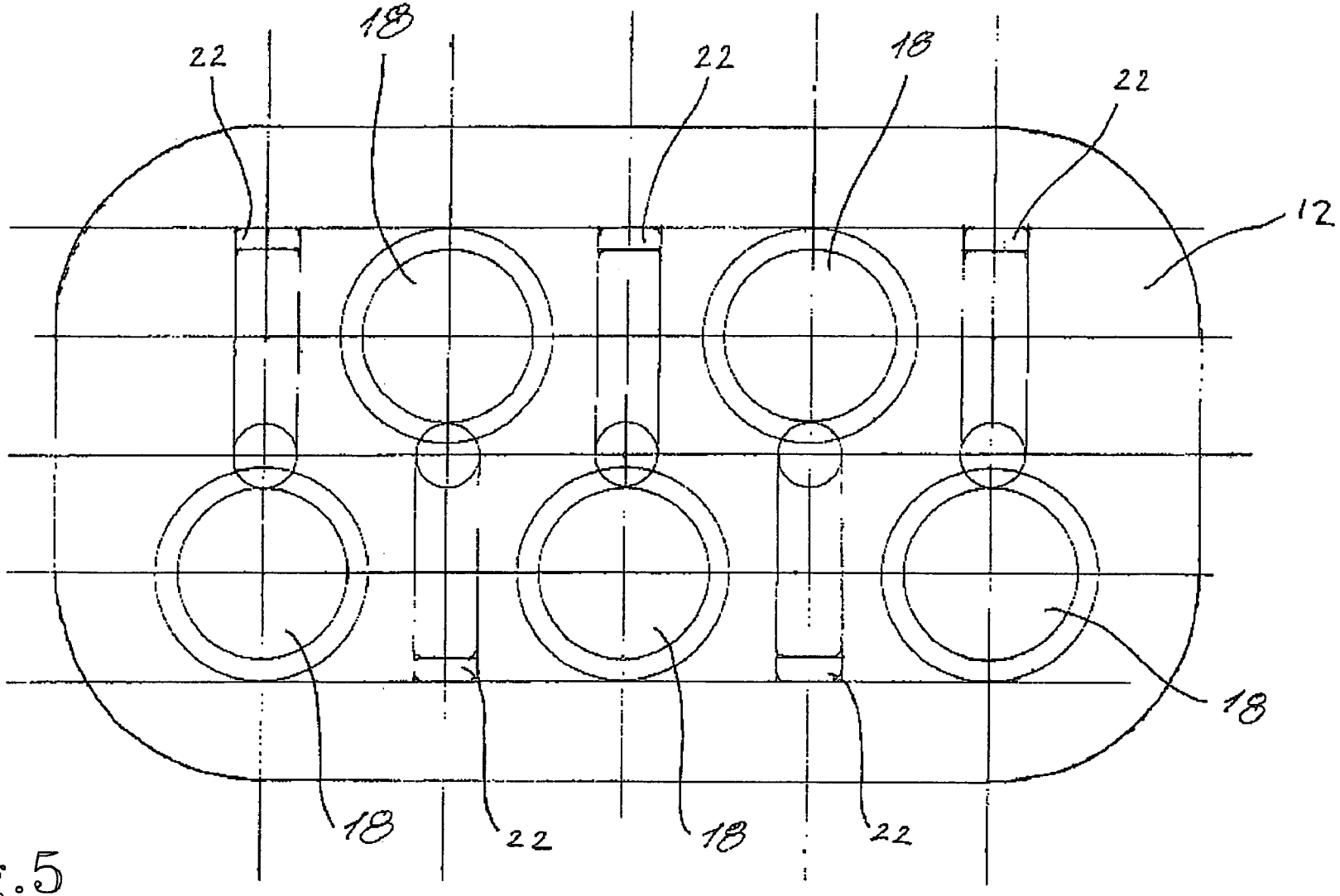
Figure 6:
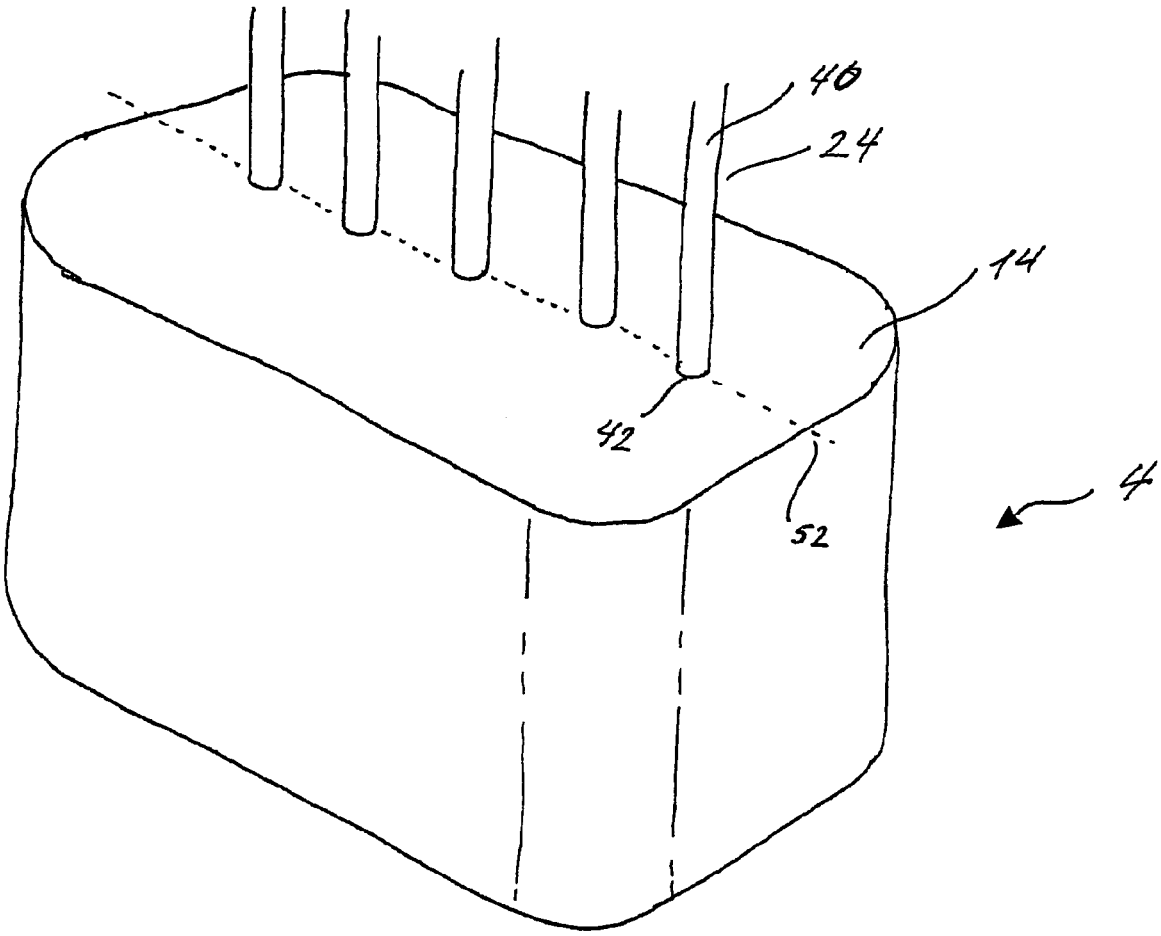
Figure 7:
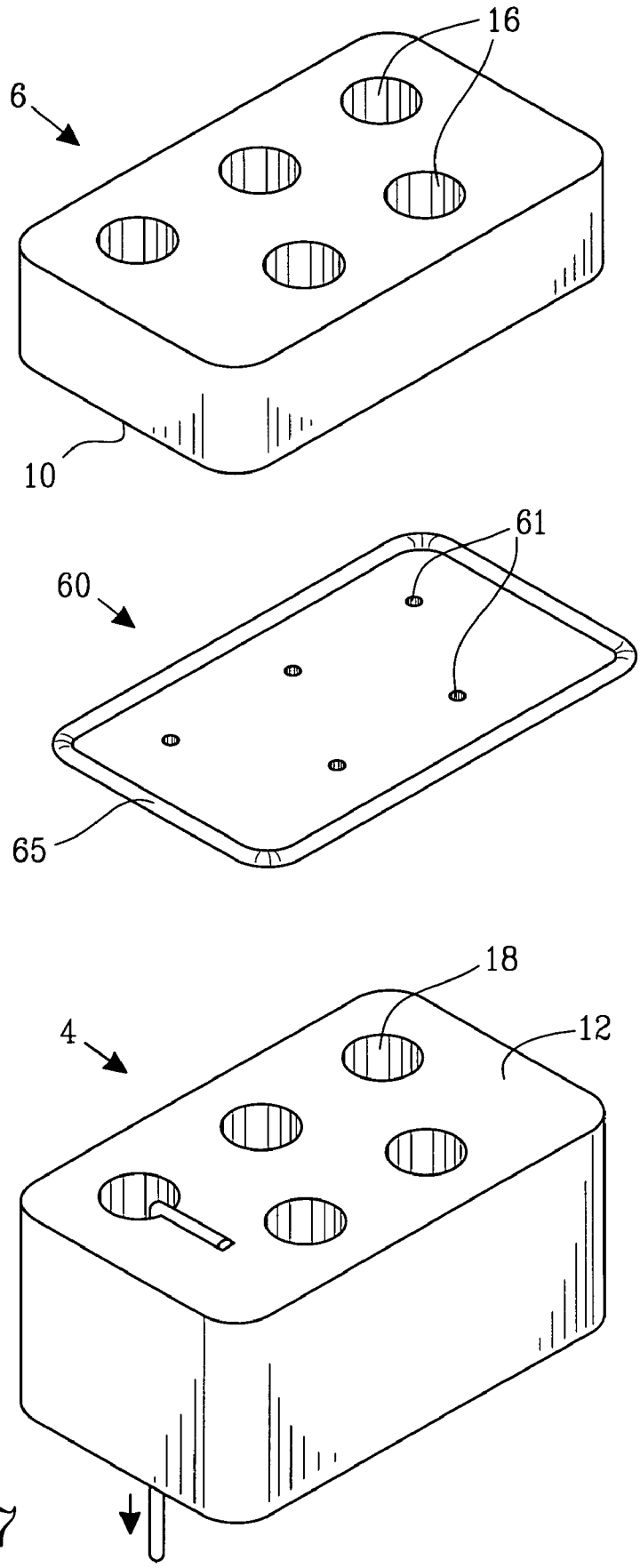
Figure 8A:
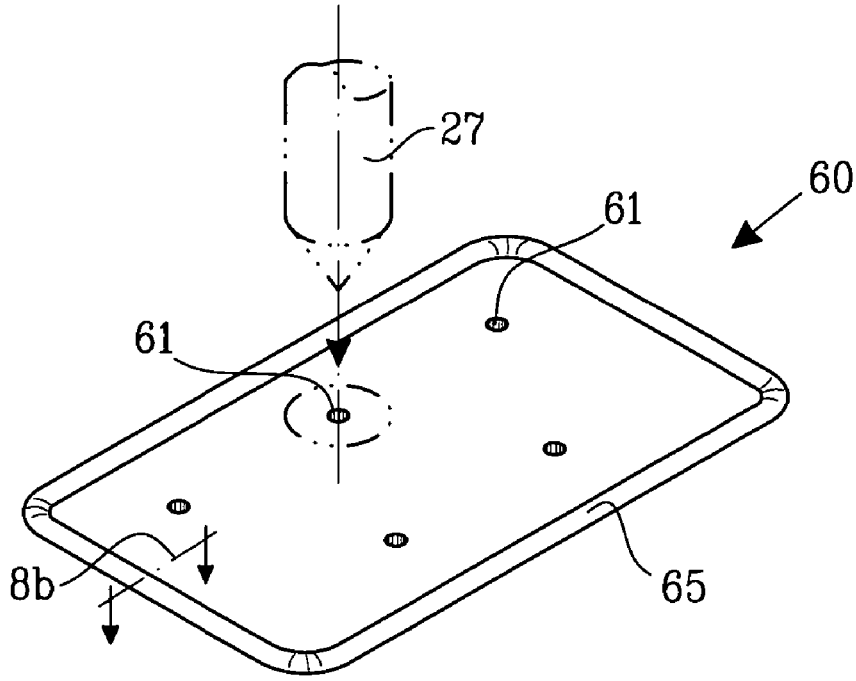
Figure 8B:
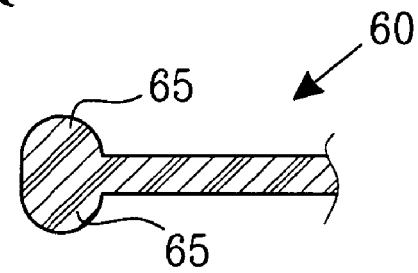
Figure 9:
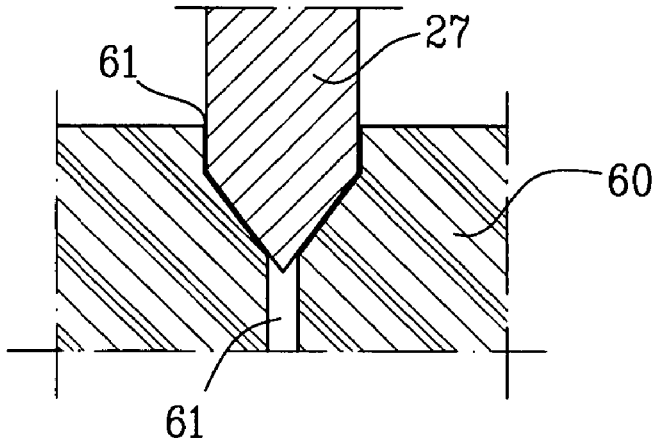

Preferred embodiments of the invention will be described in detail below with reference to the accompanying FIGS. 1–9, where FIG. 1 shows a partly exploded view of a connector according to the present invention, FIG. 2 shows a top part according to the present invention, FIG. 3 shows a base part according to the present invention, FIG. 4 shows a conductor and a sectional view of the base part according to the present invention, FIG. 5 shows a top view of the base part according to the present invention, FIG. 6 shows a rear view of the base part according to the present invention, FIG. 7 shows in an exploded view an embodiment of a base part and a top part with an intermediate flexible membrane according to the present invention, FIG. 8*a* shows a perspective view of a rod-shaped conductor and the flexible membrane according to the present invention, whereas FIG. 8*b* shows a cross-sectional view of the circumferential bead of the membrane, and FIG. 9 shows a cross-sectional view of a rod-shaped conductor entering a passage of the flexible membrane according to the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

FIG. 1 shows a female connector 2 comprising a base part 4 and a top part 6 comprising a front surface 8 and a rear surface 10. The base part 4 comprises a front surface 12 and a rear surface 14. The rear surface 10 of the top part 6 is adapted to be attached to the front surface 12 of the base part 4. The top part 6 comprises channels 16 extending from the front surface 8 to the rear surface 10. The channels 16 are adapted to receive a rod-shaped element of a male connector (not shown).

The base part 4 additionally comprises channels 18 extending from the front surface 12 to the rear surface 14. Near the front surface 12 the cross-sectional size and shape for the channels 18 is identical to the cross-sectional shape and size of the channels 16 of the top part 6. On the rear surface 10 of the top part 6, upper recess parts 20 are defined. On the front surface 12 of the base part corresponding lower recess parts 22 are defined. The upper recess parts 20 and the lower recess parts 22 together define track channels adapted to receive conductors 24. The conductors may slide in the track channel, which is indicated by the arrow 26.

FIG. 2 shows the top part 6 comprising the front surface 8, the rear surface 10 and the channels 16. The height of the side wall 28 is 0.4 mm.

FIG. 3 shows the base part 4 comprising five channels 18 having five corresponding lower recess parts 22. In a side wall of the channels 18 conductor recesses 30 are defined. These recesses are adapted to receive part of conductors 24 (not shown). The front surface 12 of the base part 4 is provided with a welding liner 32 for ultra sonic assembling the top part 6 to the base part 4. The height 34 of the base part is 1.6 mm, the width 36 of the base part 4 is 1.535 mm and the length 38 of the base part 4 is 2.67 mm.

FIG. 4 shows a cross section of the base part 4 comprising channels 18 with corresponding lower recess parts 22. In a side wall of the channels 18 conductor recesses 30 extending from the front surface 12 to the rear surface 14 are defined. The channels 18 comprise bottom surfaces 40 and, thus, a part of the conductor recesses 30 defines a small channel 42 through which conductor 24 extends.

Conductor 24 comprises three parts: 1) a second portion 44, 2) a first portion 46 and 3) a third portion 48. The track channel defined by the upper recess parts 20 and the lower recess parts 22 are adapted to slidingly receive the second portion 44 of the conductor. The conductor recess 30 is adapted to receive the first portion 46 which extends through the small channel 42 when the second portion is received in the lower recess part 22. A part of the first portion emerges on the rear surface 14 of the base part. The width 50 of the conductor 24 is 0.15 mm and the conductor comprises stainless steel—spring quality.

The third portion 48 of the resilient conductor is defined between the second portion 44 and the first portion 46. The third portion 48 is adapted to engage with at least a part of a rod-shaped conductor from a male connector assembly (not shown). The third portion 48 comprises a sharply bended section being adapted to engage with e.g. a recess of the rod-shaped conductor.

FIG. 5 shows a top view of the front surface 12 comprising channels 18 and lower recess parts 22.

FIG. 6 shows the rear surface 14 of the base part 4. A part of the first portion 46 of the conductor 24 extends through the small channel 42. The first portions of the conductors in combination define a substantially straight line 52. This is to facilitate further assembling, e.g. for soldering of the first portions.

FIG. 7 shows in an exploded view an embodiment of a base part 4 and a top part 6 with an intermediate flexible membrane 60. The flexible membrane 60, which is fabricated of a rubber-like material or a silicone material, preferably butyl-silicone, establishes a fluid tight seal between base part 4 and top part 6. Preferably, base part 4 and top part 6 comprises a material selected from the group consisting of: elastomers, polymers and any other plastic material. The projected area of the flexible membrane 60 is slightly smaller than the area of the rear surface 10 of the top part 6 and the front surface 12 of the base part 4 in order to allow abutting engagement between the rear surface 10 and the front surface 12 when assembled. In this embodiment the top part 6 is by ultrasonic means welded to the base part 4 at the abutting peripheral parts of the rear surface 10 and the front surface 12, respectively, by an ultrasonic liner (not shown). The ultrasonic welding is performed at the entire abutting periphery, optionally only in selected points, e.g. at the corners of the base part 4 and top part 6. In this way, the flexible membrane 60 is retained between the base part 4 and the top part 6. To improve the sealing the flexible membrane 60 comprises a circumferential bead 65 located on the periphery of the flexible membrane 60. Upon assembly the bead 65 is compressed in between the base part 4 and the top part 6 and provides a barrier to any incoming fluids. The flexible membrane 60 comprises a bead 65 on the side engaging the rear surface 10 and/or on the side engaging the front surface 12. Optionally, the front surface 12 and/or the rear surface 10 comprise(s) tracks for receiving the bead 65 in order to improve the fluid sealing.

Preferably, the flexible membrane having five passages 61 each adapted to receive a rod-shaped conductor of the male connector is positioned between base part 4 and top part 6 when assembled. In order for the rod-shaped connector to be able to engage with the conductors channels 18 of base part 4, the five passages 61 should be aligned with the five conductor channels 18.

FIG. 8*a* shows a perspective view of a rod-shaped conductor 27 and the flexible membrane 60. It is indicated how the conductor 27 is intended to penetrate the flexible membrane 60 through the passage 61. The passage 61 has the form of a tubular hole with at least a closed position in which the passage 61 provides a fluid tight sealing and a receiving position in which the passage is capable of receiving the rod-shaped conductor 27. In the receiving position the rod-shaped conductor 27 penetrating the passage 61 elastically extends the passage 61. Due to the elastic extension of the passage 61, the passage 61 provides a close fit around the rod-shaped conductor 27 so as to obtain a fluid tight sealing in the receiving position of the passage 61. In the closed position the passage 61 has a maximum diameter of approximately 0.1 mm while the diameter in the receiving position is extendable up to at least 0.15 mm. FIG. 8*b* shows a cross-sectional view of the circumferential bead 65 of the membrane.

FIG. 9 shows a cross-sectional view of a rod-shaped conductor 27 entering a passage 61 of the flexible membrane 60. Upon entry of the rod-shaped conductor 27 the engaging sides of the passage 61 are bent downwards. In this embodiment the passage 61 has the form of tubular hole but many alternatives shapes and variations are available. The passage 61 may in a cross-sectional view e.g. have a tapering profile with an entry diameter being larger than the rear exit diameter so as to facilitate easy entry of the rod-shaped conductor 27. In particular, the passage 61 may in a cross-sectional view have a conical form with the base of the cone pointing in the direction of the rear surface 10 which is the side where conductor 27 approaches. Alternatively, the base of the cone may be pointing in the direction of the front surface 12. As the rod-shaped conductor 27 has a substantially circular form in a plane substantially perpendicular to the conductor channels, the passage 61 in the flexible membrane 60 may correspondingly define, in a plane substantially perpendicular to the conductor channels, a substantially circular opening in order to provide an optimal closest fit in a receiving position of the passage 61.

More alternatively, the passage 61 may comprise cut out slits (not shown) in the flexible membrane 60 to facilitate easy access for the conductor 27. The slits may have a common centre of origin and be symmetrically arranged around said centre of origin, e.g. four slits in the flexible membrane 60 with a common centre of origin may be oriented at right angles to each other forming a cross seen from a top view. Possibly, slits and holes of various forms may be combined to form different kinds of passages 61 adapted to provide a fluid tight sealing in both a closed position and a receiving position.

What is claimed is:

1. A female connector assembly, comprising a base part comprising one or more conductor channels, each conductor channel having a longitudinal centre axis, a first end, and a second end, and a bent resilient conductor comprising first and second portions separated by a bend and having the first portion positioned in a conductor channel, wherein said conductor channel is adapted to receive a rod-shaped conductor from a male connector assembly so that the rod-shaped conductor is retained in said conductor channel by a biasing force provided by the bent resilient conductor positioned in said conductor channel, wherein the second portion of the bent resilient conductor is displaceable in a track disposed at a surface of the base part upon receiving the rod-shaped conductor in said conductor channel.

2. The female connector according to claim 1, wherein the first and second portions of the bent resilient conductor are substantially perpendicular.

3. The female connector according to claim 1, wherein the track is disposed at a surface of the base part being substantially perpendicular to the centre axis of said conductor channel.

4. The female connector according to claim 1, wherein each of the one or more conductor channels hosts at least one bent resilient conductor.

5. The female connector according to claim 1, wherein the track extends in a direction substantially transverse to the centre axis of the conductor channel.

6. The female connector according to claim 1, wherein at least a part of the track, in a cross-section, defines a semi-circle.

7. The female connector according to claim 1, wherein at least a part of the track encircles at least a part of the second portion of the bent resilient conductor displaced in the track.

8. The female connector according to claim 1, further comprising a top part arranged on the base part.

9. The female connector according to claim 8, wherein the base part and the top part, in combination, defines the track.

10. The female connector according to claim 9, wherein the track is defined by a first recess defined in a surface of the base part and a second recess defined in a surface of the top part.

11. The female connector according to claim 8, wherein the top part is fixedly attached to the base part.

12. The female connector according to claim 1, wherein a conductor recess is defined in at least one of the conductor channels.

13. The female connector according to claim 12, wherein the conductor recess extends continuously from the first end of the conductor channel to the second end of the conductor channel.

14. The female connector according to claim 13, wherein the first portion of the bent resilient connector is adapted to be received in the conductor recess when the second portion is received in the track.

15. The female connector according to claim 1, wherein a third portion of the bent resilient conductor is defined between the first portion and the second portion, the third portion being adapted to engage with at least a part of the rod-shaped conductor from the male connector assembly.

16. The female connector according to claim 1, further comprising blocking means for blocking at least a part of the track so as to limit the sliding movement of the second portion of the bent resilient conductor when displaced in the track.

17. The female connector according to claim 1, further comprising sealing means adapted to seal at least one of the conductor channels, the sealing means further being adapted to provide a fluid tight seal.

18. The female connector according to claim 17, wherein the sealing means comprises a flexible membrane having at least one passage adapted to receive the rod-shaped conductor of the male connector, the at least one passage being aligned with a conductor channel.

19. The female connector according to claim 18, wherein the flexible membrane comprises a material selected from the group consisting of: silicone, butyl-silicone, and rubber material.

20. The female connector according to claim 18, wherein the at least one passage defines, in the plane of the membrane, a substantially circular opening.

21. The female connector according to claim 18, wherein the flexible membrane comprises at least one bead.

22. The female connector according to claim 17, wherein the sealing means is positioned between the base part and a top part.

23. The female connector according to claim 22, wherein the sealing means is fastened to the base part and/or to the top part using a method selected from the group consisting of: ultrasonic welding, welding, laser welding, gluing, joining by adhesive strips, and joining by heating.

24. The female connector according to claim 22, wherein the top part is fastened to the base part using a method selected from the group consisting of: snap locking, interface locking, clamping, ultrasonic welding, welding, gluing, and joining by heating.

25. The female connector according to claim 1, having in the range from 3 to 5 conductor channels.

26. The female connector according to claim 1, wherein the volume of the connector is between 2 $mm^3$ and 10 $mm^3$.

27. The female connector according to claim 26, wherein the volume of the connector is between 4 $mm^3$ and 8 $mm^3$.

28. The female connector according to claim 27, wherein the volume of the connector is between 5 $mm^3$ and 7 $mm^3$.

29. The female connector according to claim 28, wherein the volume of the connector is approximately 6 $mm^3$.

30. The female connector according to claim 1, wherein the area of a cross-section of at least one of the conductor channels is between 0.1 and 0.3 $mm^2$.

31. The female connector according to claim 30, wherein the area of a cross-section of at least one of the conductor channels is approximately 0.2 $mm^2$.

32. The female connector according to claim 1, wherein at least one of the bent resilient conductors comprises a material selected from the group consisting of aluminium, magnesium, titanium, copper, nickel, zinc, tin, lead, chrome, tungsten, molybdenum, silver, gold, platinium, and any alloy thereof.

33. The female connector according to claim 1, wherein the base part and/or a top part comprises a material selected from the group consisting of elastomers, polymers and any other plastic material.

34. The female connector according to claim 1, wherein the base part and/or a top part defines, in a plane substantially perpendicular to the centre axis of the conductor channel, a substantially rectangular cross-sectional shape.

35. The female connector according to claim 1, wherein the base part and/or a top part defines, in a plane substantially perpendicular to the centre axis of the at least one conductor channel, a substantially circular cross-sectional shape.

* * * * *